US007601927B2

(12) United States Patent
Egea Soler

(10) Patent No.: US 7,601,927 B2
(45) Date of Patent: Oct. 13, 2009

(54) ROCKER KEY WITH LED WINDOW

(75) Inventor: Cristina Egea Soler, Barcelona (ES)

(73) Assignee: Simon, S.A., Barcelona (ES)

( * ) Notice: Subject to any disclaimer, the term of this patent is extended or adjusted under 35 U.S.C. 154(b) by 61 days.

(21) Appl. No.: 11/861,584

(22) Filed: Sep. 26, 2007

(65) Prior Publication Data

US 2008/0078665 A1 Apr. 3, 2008

(30) Foreign Application Priority Data

Sep. 28, 2006 (ES) ..... 200602118 U

(51) Int. Cl.
*H01H 3/00* (2006.01)

(52) U.S. Cl. ..... 200/315; 200/339

(58) Field of Classification Search ..... 200/313–316, 200/329, 339, 553
See application file for complete search history.

(56) References Cited

U.S. PATENT DOCUMENTS 4,472,610 A * 9/1984 Fuller et al. ..... 200/5 A
6,344,622 B1 * 2/2002 Takiguchi et al. ..... 200/314
6,355,891 B1 * 3/2002 Ikunami ..... 200/315
6,382,809 B1 * 5/2002 Ou-Yang ..... 362/102
6,677,545 B2 * 1/2004 Kenmochi ..... 200/314
6,713,698 B2 * 3/2004 Kashino ..... 200/341
6,809,278 B2 * 10/2004 Tsubaki ..... 200/341
7,041,922 B2 * 5/2006 Geiger et al. ..... 200/296
7,135,650 B2 * 11/2006 Jung ..... 200/314
7,235,754 B2 * 6/2007 Rochon et al. ..... 200/406
7,339,128 B2 * 3/2008 Yen ..... 200/314
7,351,928 B2 * 4/2008 Harada ..... 200/302.1
7,470,869 B2 * 12/2008 Lin ..... 200/341
7,476,820 B2 * 1/2009 Aubert Capella ..... 200/315

* cited by examiner

*Primary Examiner*—Michael A Friedhofer
*Assistant Examiner*—Lisa N Klaus
(74) *Attorney, Agent, or Firm*—Michael J. Striker

(57) ABSTRACT

A Rocker key with LED window and chromatic cover for actuating electrical mechanisms, characterized in that it comprises a lower perimeter rim with a rectangular section, on the upper and horizontal flat face of which the cover rests entirely, fitted through pressure on the key in such a way that the key is totally covered by said cover, while uncovered and visible from the outside is the vertical outer face of the lower perimeter rim of the key, which is elevated according to its normal rocking movement.

4 Claims, 3 Drawing Sheets

ROCKER KEY WITH LED WINDOW

CROSS-REFERENCE TO A RELATED APPLICATION

The invention described and claimed hereinbelow is also described in Spanish Patent Application 20060118 filed on Sep. 28, 2006. This Spanish application, which subject matter is incorporated here by reference provides the basis for a claim of priority of invention under 35 U.S.C. 119(a)-(d).

BACKGROUND OF THE INVENTION

The present invention relates to a rocker key designed for applying to electrical devices as their actuating element, provided with a LED window for signage and location situated on its upper surface.

The key is characterised in that it has a lower perimeter rim, whose outer face is visible in full when a chromatic cover is fitted through pressure covering the entire rest of the key.

SUMMARY OF THE INVENTION

The essential characteristics of the invention are described as follows:

In electrical installations of a domestic type or designed for offices and shops, which are generally built-in, it is evidently important to adapt the outer parts of the mechanisms such as base plates and rocker keys to the chromatic assembly of the place.

Occasionally, it is necessary to change this finish to facilitate location by users.

Placing a cover in a transparent or translucent material over the key will result in the user observing a specific chromatic element, and in a visible manner, given the fact that the LED window of the key will offer the relevant diffuse luminosity, with the required chromatic incidence of the cover, as distinct from that of the key.

At the same time, in the invention described herein, the cover which totally surrounds the body of the key leaves the key's perimeter rim totally and perfectly visible when it is in the lifted position according to its normal rocking or swinging movement.

Therefore, its chromatic finish is totally perceptible, attending to a possible or necessary differentiation from the cover, for its location or signposting.

DESCRIPTION OF THE PREFERRED EMBODIMENTS

Figure 1:
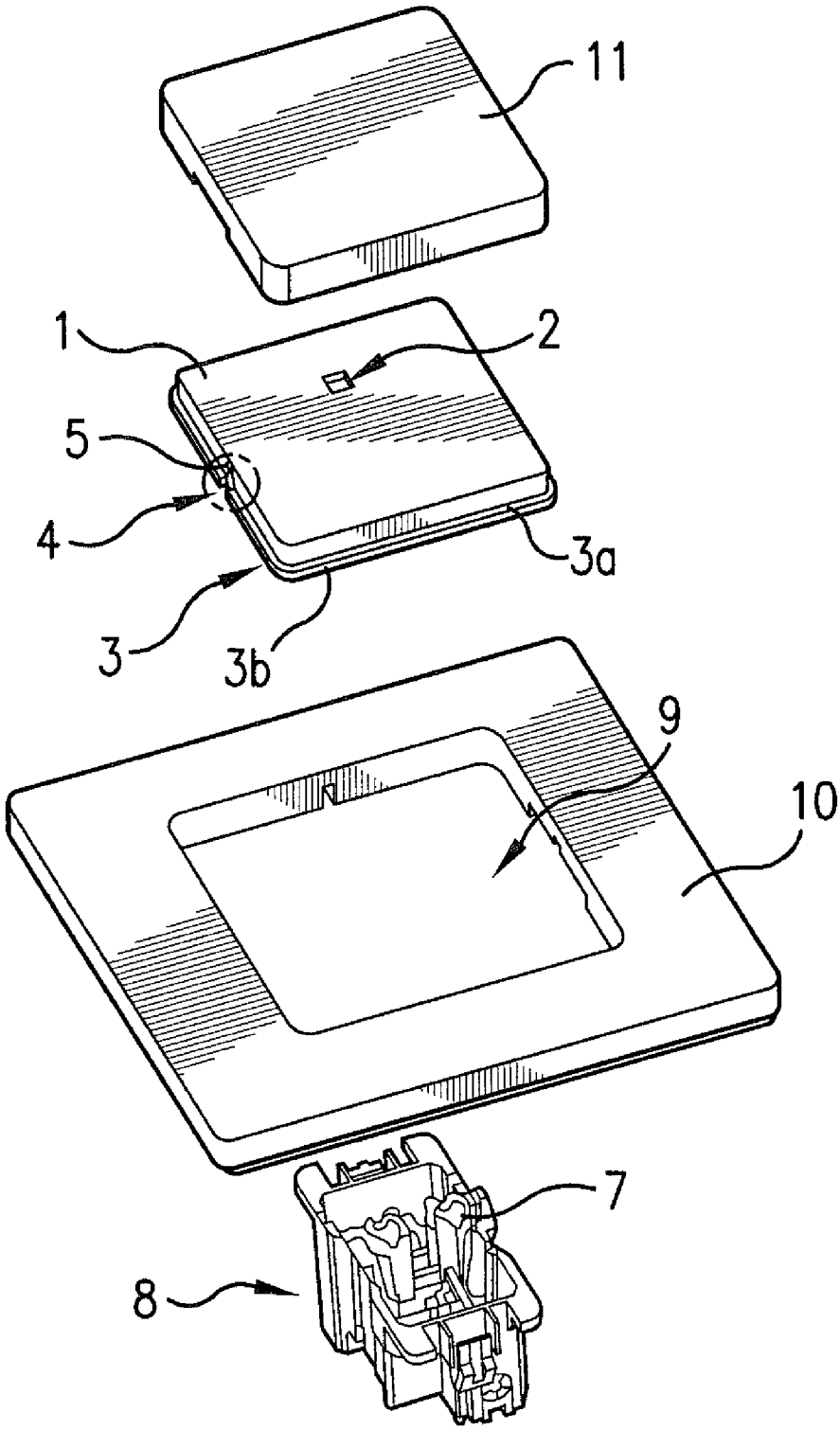
FIG. 1 is an exploded perspective view of the rocker key in the assembly of the electrical device in which it is installed.
Figure 2:
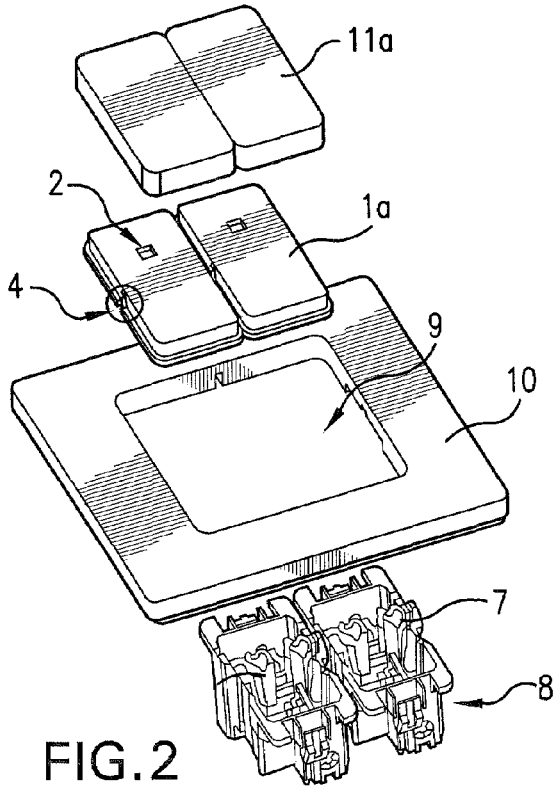
FIG. 2 is a similar perspective to that of the preceding drawing, but in an embodiment that contemplates two half-module rocker keys, to actuate two distinct mechanisms.
Figure 3:
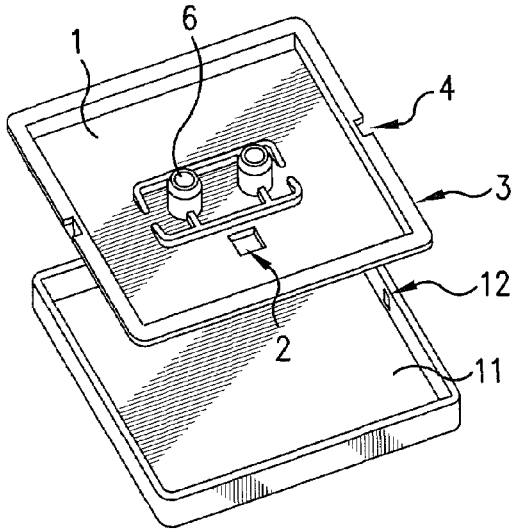
FIG. 3 is an exploded perspective view of the key and its cover, seen from below.
Figure 4:
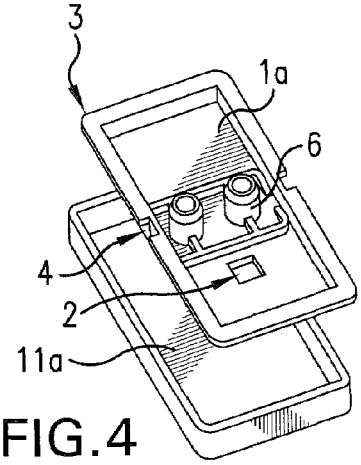
FIG. 4 is a similar view to that of the preceding figure, but corresponding to a single half-module key.
Figure 5:
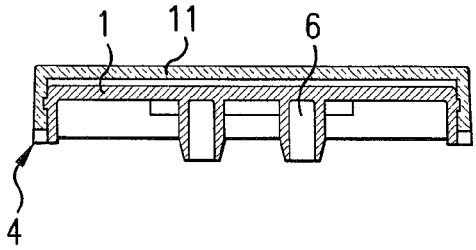
FIG. 5 is a section view of the assembly of the cover placed on the key.
Figure 6:
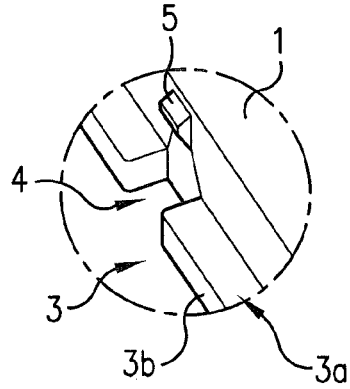
FIG. 6 is a close-up of FIG. 1, in perspective, and in larger scale, of the retaining projection that the key has on its two opposite sides.
Figure 7:
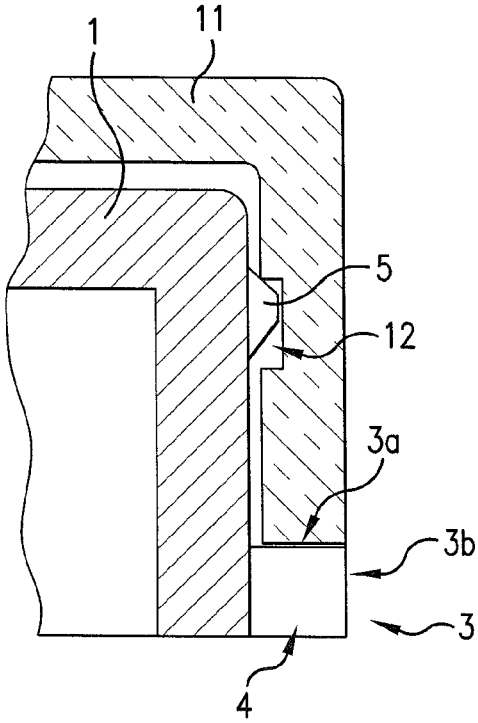
FIG. 7 is a close-up also in larger scale, of the section of the key with the cover fitted, in the area of the retaining projection.
Figure 8:
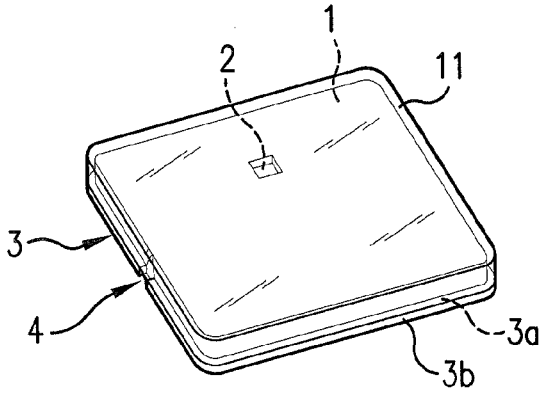
FIG. 8 is a view in perspective of the assembly of the key and cover, joined.

In accordance with the drawings, the rocker key (1) provided with a LED window (2) has a lower perimeter rim (3) with a rectangular section.

This rim is interrupted on two of its sides, by a notch (4), in the place coinciding with the retaining projection (5) that the key (1) has on the two same sides.

From the lower face of the key (1) two protrusions (6) emerge that allow it to be fixed on to the appropriate rocker arm (7) of the electrical mechanism (8), after positioning the key (1) in the corresponding window (9) of the base plate (10).

The cover (11) that is fitted on top of the key (1) is left with its lower edge resting totally on the flat upper face (3*a*) of the perimeter rim (3) of the key (1).

With the cover (11) thus installed, its chromatic aspect will be visible, in addition to the chromatic finish of the vertical outer face (3*b*) of the abovementioned perimeter rim (3), identical to that of the key (1), meaning that the user will be able to perceive two different-coloured elements: the cover (11) and the outer face (3*b*) of the rim (3) of the key (1).

Given the transparency of the cover (1), the luminosity transmitted through the window (2) of the key (1) confers on the upper surface of the entire cover (11) sufficient light for it to be signposted or located.

The cover (11) has inside its two side faces, respective rectangular grooves (12) coinciding in their position with the retaining projections (5) of the key (1) in such a way that when the cover (11) is fitted on the key (1), it will hook onto it through pressure and remain fixed by the action of the projections (5) slotting into the grooves (12).

The notches (4) of the rim (3) allow, with the use of the appropriate tool, the projections (5) to be acted on so as to release the cover (11) easily.

In the embodiment with the two half-module keys (1*a*) the covers (11*a*) must have the right size but attach to the key in an identical manner.

Having sufficiently described the object of this invention, it is noted that its essential nature will not be altered by variations in size, shapes, materials or finishes, as described in the following claims.

The invention claimed is:

1. Rocker key with a LED window and chromatic cover for actuating electrical mechanisms, comprising a lower perimeter rim that completely and continuously surrounds the rocker key, the rim further comprises a rectangular upper and horizontal flat face of which the cover rests entirely, fitted through pressure on the key in such a way that the key is totally covered by said cover, while uncovered and visible from the outside is the vertical outer face of the lower perimeter rim of the key, which is elevated according to its normal rocking movement.

2. Rocker key with LED window and chromatic cover for actuating electrical mechanisms, according to claim 1, characterised in that the perimeter rim is interrupted on two of the opposite sides of the key by relevant notches on which and in the corresponding outer faces of the vertical walls of the key are situated retaining projections on which, when the cover is fitted onto the key rectangular grooves are positioned that the cover has, meaning that it will become hooked over the projections and fixed to the key, allowing the notches to act on the projections to liberate the cover from its fitted position.

3. Rocker key with LED window and chromatic cover for actuating electrical mechanisms, according to claim 1, characterised in that the cover, made of a transparent material and with a different chromatic finish to that of the key, on fitting over it, will make visible throughout its entire upper surface the light transmitted through the window of the key, allowing it to be signposted or located, completed with the chromatic view of the outer vertical wall of the rim, normally different to the cover.

4. Rocker key with LED window and chromatic cover for actuating electrical mechanisms, according to claim 1, characterised in that it presents, as a variation, two half-module keys for actuating two distinct electrical mechanisms, on which the right-sized covers will be fitted, fixed in an identical manner and with identical characteristics, keys that, like key are positioned in the window of the base plate.

* * * * *